US009139918B2

(12) United States Patent
Yao et al.

(10) Patent No.: US 9,139,918 B2
(45) Date of Patent: Sep. 22, 2015

(54) FLUORINE GAS GENERATING APPARATUS

(75) Inventors: Akifumi Yao, Ube (JP); Keita Nakahara, Ube (JP)

(73) Assignee: CENTRAL GLASS COMPANY, LIMITED, Ube-shi (JP)

( * ) Notice: Subject to any disclaimer, the term of this patent is extended or adjusted under 35 U.S.C. 154(b) by 122 days.

(21) Appl. No.: 13/640,877

(22) PCT Filed: Apr. 4, 2011

(86) PCT No.: PCT/JP2011/058532

§ 371 (c)(1),
(2), (4) Date: Oct. 12, 2012

(87) PCT Pub. No.: WO2011/129219

PCT Pub. Date: Oct. 20, 2011

(65) Prior Publication Data

US 2013/0032471 A1 Feb. 7, 2013

(30) Foreign Application Priority Data

Apr. 16, 2010 (JP) ..... 2010-095219

(51) Int. Cl.
*C25B 1/24* (2006.01)
*C25B 15/02* (2006.01)
*C25B 9/00* (2006.01)

(52) U.S. Cl.
CPC . *C25B 1/245* (2013.01); *C25B 9/00* (2013.01); *C25B 15/02* (2013.01)

(58) Field of Classification Search
CPC ..... C25B 1/245; C25B 15/02; C25B 9/00
See application file for complete search history.

(56) References Cited

U.S. PATENT DOCUMENTS

2007/0215460 A1 * 9/2007 Tojo et al. ..... 204/245

FOREIGN PATENT DOCUMENTS

| | | | | |
|---|---|---|---|---|
| JP | 2004-043885 A | | 2/2004 | |
| JP | 2004-124148 A | | 4/2004 | |
| JP | 2004-353015 A | | 12/2004 | |
| JP | 2005-180545 A | | 7/2005 | |
| JP | 2005180545 A | * | 7/2005 | ..... F17C 5/06 |
| JP | 2007-048599 A | | 2/2007 | |
| WO | WO 2004007802 A2 | * | 1/2004 | ..... C25B 1/24 |

OTHER PUBLICATIONS

International Search Report for PCT/JP2011/058532, mailing date of Jul. 5, 2011.

* cited by examiner

*Primary Examiner* — Harry D Wilkins, III
*Assistant Examiner* — Ciel Thomas
(74) *Attorney, Agent, or Firm* — Westerman, Hattori, Daniels & Adrian, LLP

(57) ABSTRACT

A fluorine gas generating apparatus includes: a first main passage connected to a first gas chamber and supplying a fluorine gas to an external device; a first conveying device leading out and conveying the fluorine gas from the first gas chamber; a first pressure detector detecting the pressure on the upstream side of the first conveying device; a first pressure regulating valve returning the fluorine gas from the first conveying device to the suction side of the first conveying device; a controller controlling the opening degree of the first pressure regulating valve so that the pressure detected by the first pressure detector becomes a first set value; a start valve provided on the upstream side of the pressure detector; and a differential pressure detector for detecting the pressure difference before and after the start valve in the closed valve state.

2 Claims, 6 Drawing Sheets

FLUORINE GAS GENERATING APPARATUS

BACKGROUND OF THE INVENTION

The present invention relates to a fluorine gas generating apparatus.

As a prior-art fluorine gas generating apparatus, an apparatus which generates fluorine gas by electrolysis using an electrolytic cell is known.

JP2004-43885A discloses a fluorine gas generating apparatus provided with an electrolytic cell for generating a product gas mainly containing a fluorine gas in a first gas-phase section on an anode side and for generating a byproduct gas mainly containing a hydrogen gas in a second gas phase section on a cathode side, first and second pressure meters for measuring pressures of the first and second gas-phase sections, first and second pipelines for deriving the product gas and the byproduct gas, first and second flow control valves disposed in the first and second pipelines, and first and second suctioning means located downstream of the first and second flow control valves and for suctioning the first and second pipelines.

Since a fluorine gas has high reactivity, if a liquid level of the electrolytic cell is largely fluctuated, there is a concern that the fluorine gas and a hydrogen gas are brought into contact and react with each other.

SUMMARY OF THE INVENTION

With the fluorine gas generating apparatus described in JP2004-43885A, there is a concern that the liquid level of the electrolytic cell rapidly fluctuates by a suction pressure of the suctioning means when the suctioning means is started at the start of the fluorine gas generating apparatus. In that case, it is concerned that the fluorine gas is brought into contact with the hydrogen gas.

The present invention was made in view of the above problem and has an object to suppress fluctuation in the liquid level of the electrolytic cell at the start of the fluorine gas generating apparatus.

The present invention is a fluorine gas generating apparatus for generating a fluorine gas by electrolyzing hydrogen fluoride in molten salt, including: an electrolytic cell in which a first gas chamber into which a product gas mainly containing the fluorine gas generated at an anode immersed in the molten salt is led and a second gas chamber into which a byproduct gas mainly containing a hydrogen gas generated at a cathode immersed in the molten salt is led are separated and defined on a liquid level of the molten salt; a main passage connected to the first gas chamber and supplying the product gas generated at the anode of the electrolytic cell to an external device; a conveying device provided in the main passage and leading out and conveying the product gas from the first gas chamber; a pressure detector for detecting a pressure on an upstream side of the conveying device in the main passage; a reflux passage connecting a discharge side and a suction side of the conveying device; a pressure regulating valve provided in the reflux passage and returning the product gas discharged from the conveying device to the suction side of the conveying device; a controller for controlling an opening degree of the pressure regulating valve so that the pressure detected by the pressure detector becomes a set value determined in advance; a start valve provided on an upstream side of the pressure detector in the main passage and allowing a flow of the product gas generated at the anode by opening at start of the fluorine gas generating apparatus; and a differential pressure detector for detecting a pressure difference before and after the start valve in a closed valve state, wherein at start of the fluorine gas generating apparatus, the controller changes the set value so that the pressure difference detected by the differential pressure detector falls within a set range determined in advance and opens the start valve when the pressure difference falls within the set range.

According to the present invention, at the start of the fluorine gas generating apparatus, the controller changes a set value so that a pressure difference detected by a differential pressure detector is within a set range determined in advance and opens a start valve when the pressure difference falls within the set range. Therefore, the start valve is opened while the pressure difference between upstream and downstream is small and a first gas chamber is connected to a conveying device. Accordingly, at the start of the fluorine gas generating apparatus, fluctuation in a liquid level of the electrolytic cell can be suppressed.

DESCRIPTION OF THE EMBODIMENTS

Figure 1:
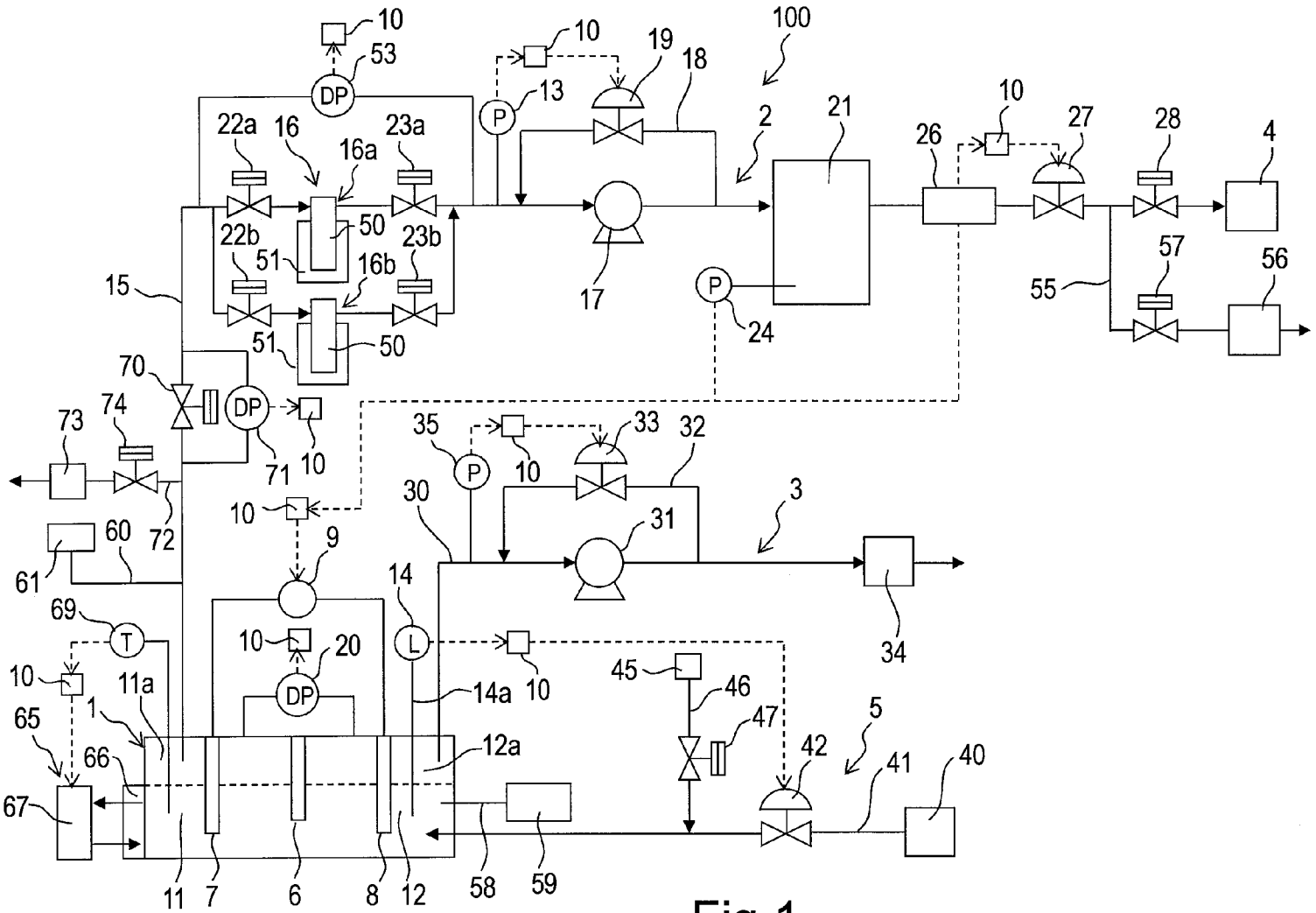
FIG. 1 is a system diagram illustrating a fluorine gas generating apparatus according to an embodiment of the present invention.

An embodiment of the present invention will be described below by referring to the attached drawings.

A fluorine gas generating apparatus 100 according to the embodiment of the present invention will be described by referring to FIG. 1.

The fluorine gas generating apparatus 100 generates a fluorine gas by electrolysis and supplies the generated fluorine gas to an external device 4. The external device 4 is a semiconductor manufacturing device, for example, and in that case, the fluorine gas is used as a cleaning gas in a manufacturing process of a semiconductor, for example.

The fluorine gas generating apparatus 100 includes electrolytic cell 1 which generates a fluorine gas by electrolysis, a fluorine gas supply system 2 which supplies the fluorine gas generated from the electrolytic cell 1 to the external device 4, and a byproduct gas treatment system 3 which treats a byproduct gas generated with the generation of the fluorine gas. Additionally, the fluorine gas generating apparatus 100 includes a controller 10 as a controller for controlling operations of the equipment and valves according to detection results from measuring instruments. The controller 10 consists of a microcomputer including CPU, ROM and RAM.

First, the electrolytic cell 1 will be described.

The electrolytic cell 1 retains molten salt containing hydrogen fluoride (HF). In this embodiment, a mixture (KF.2HF) of hydrogen fluoride and potassium fluoride (KF) is used as the molten salt.

The inside of the electrolytic cell 1 is divided by a partition wall 6 immersed in the molten salt to an anode chamber 11 and a cathode chamber 12. An anode 7 and a cathode 8 are immersed in the molten salt in the anode chamber 11 and the cathode chamber 12, respectively. By means of supply of an electric current between the anode 7 and the cathode 8 from a power supply 9, a product gas mainly containing a fluorine gas ($F_2$) is generated at the anode 7, while a byproduct gas mainly containing a hydrogen gas ($H_2$) is generated at the cathode 8. A carbon electrode is used for the anode 7, while soft iron, monel or nickel is used for the cathode 8.

Above the liquid level of the molten salt in the electrolytic cell 1, a first gas chamber 11*a* into which the fluorine gas generated at the anode 7 is introduced and a second gas chamber 12*a* into which the hydrogen gas generated at the cathode 8 is led are partitioned by a partition wall 6 from each other so that the gases cannot go out of or come into each other. As described above, the first gas chamber 11*a* and the second gas chamber 12*a* are completely separated by the partition wall 6 in order to prevent reaction by contact between the fluorine gas and the hydrogen gas. On the other hand, the molten salt in the anode chamber 11 and the cathode chamber 12 is not separated by the partition wall 6 but communicates with each other below the partition wall 6.

A temperature of the molten salt in the electrolytic cell 1 is adjusted to 71.7° C. which is a melting point of KF.2HF or more, specifically to 85 to 95° C. by a temperature adjusting device 65. In the electrolytic cell 1, a thermometer 69 as a temperature detector for detecting a temperature of the molten salt is provided. A detection result of the thermometer 69 is outputted to a controller 10.

The temperature adjusting device 65 is provided with a jacket 66 provided on an outer wall of the electrolytic cell 1, a tube (not shown) provided inside the electrolytic cell 1, and a heating/cooling device 67 for circulating steam or cooling water through the jacket 66 and the tube. In order to raise the temperature of the molten salt, steam is made to flow from the heating/cooling device 67 through the jacket 66 and the tube, while in order to lower the temperature of the molten salt, cooling water is made to flow form the heating/cooling device 67 through the jacket 66 and the tube to adjust the temperature. Moreover, either one of the jacket 66 and the tube may be provided. Instead of circulating steam or cooling water through the jacket 66 and the tube, a hot refrigerant such as silicon oil may be circulated. Moreover, a heat exchanger such as a heater, a capacitor or the like may be provided on the outer wall of the electrolytic cell 1 so as to adjust the temperature of the molten salt.

Hydrogen fluoride is evaporated from the molten salt by an amount of a vapor pressure and mixed in each of the fluorine gas and the hydrogen gas generated from the anode 7 and the cathode 8 of the electrolytic cell 1. As described above, a hydrogen fluoride gas is contained in each of the fluorine gas generated at the anode 7 and introduced into the first gas chamber 11*a* and the hydrogen gas generated at the cathode 8 and introduced into the second gas chamber 12*a*.

In the electrolytic cell 1, a liquid level meter 14 as a liquid level detector for detecting a liquid level of the retained molten salt is provided. The liquid level meter 14 is a back-pressure type liquid level meter which detects a back pressure when a given flow rate of a nitrogen gas is purged into the molten salt through an insertion pipe 14*a* inserted into the electrolytic cell 1 and detects the liquid level from the back pressure and a liquid specific gravity of the molten salt. A detection result of the liquid level meter 14 is outputted to the controller 10.

Moreover, in the electrolytic cell 1, a first differential pressure meter 20 as a differential pressure detector for detecting a pressure difference between the first gas chamber 11*a* and the second gas chamber 12*a* is provided. A detection result of the first differential pressure meter 20 is outputted to the controller 10.

Subsequently, the fluorine gas supply system 2 will be described.

A first main passage 15 for supplying the fluorine gas to the external device 4 is connected to the first gas chamber 11*a*.

In the first main passage 15, a first pump 17 as a conveying device which leads and conveys the fluorine gas out of the first gas chamber 11*a* is provided. A positive-displacement pump such as a bellows pump, a diaphragm pump or the like is used for the first pump 17. To the first main passage 15, a first reflux passage 18 for connecting a discharge side and a suction side of the first pump 17 is connected. In the first reflux passage 18, a first pressure regulating valve 19 for returning the fluorine gas discharged from the first pump 17 to the suction side of the first pump 17 is provided.

On the upstream of the first pump 17 in the first main passage 15, a first pressure meter 13 as a pressure detector for detecting a pressure of the first main passage 15 is provided. A detection result of the first pressure meter 13 is outputted to the controller 10.

An opening degree of the first pressure regulating valve 19 is controlled on the basis of a signal outputted from the controller 10. Specifically, the opening degree of the first pressure regulating valve 19 is controlled so that a pressure detected by the first pressure meter 13 becomes a first set value stored in a ROM and determined in advance.

On the upstream of the first pressure meter 13 in the first main passage 15, a start valve 70 which is opened at the start of the fluorine gas generating apparatus 100 and allows a flow of the fluorine gas generated at an anode 7 is provided. The start valve 70 is in open state all the time during a normal operation of the fluorine gas generating apparatus 100. In the first main passage 15, a second differential pressure meter 71 is provided as a differential pressure detector for detecting a pressure difference between before and after the start valve 70 in a closed valve state. A detection result of the second differential pressure meter 71 is outputted to the controller 10. The controller 10 executes control so that at the start of the fluorine gas generating apparatus 100, if a differential pressure detected by the second differential pressure meter 71 is within a set range stored in the ROM and determined in advance, the start valve 70 is opened. Detailed control will be described later.

To the upstream of the start valve 70 in the first main passage 15, a branch passage 72 is connected, and an abatement section 73 is provided on a downstream end of the branch passage 72. In the branch passage 72, a first shut-off valve 74 for switching between flow and shut-off of the fluorine gas is provided. If the start valve 70 is in a closed valve state and the first shut-off valve 74 is in an open valve state, the fluorine gas generated at the anode 7 is discharged through the branch passage 72, made harmless in the abatement section 73 and emitted.

On the upstream of the first pump 17 in the first main passage 15, a refining device 16 for catching the hydrogen fluoride gas mixed in the fluorine gas and refining the fluorine gas is provided. The refining device 16 is composed of two systems, that is, a first refining device 16*a* and a second refining device 16*b* provided in parallel. Each of the first refining device 16*a* and the second refining device 16*b* is provided with a gas passage section 50 through which the fluorine gas passes and a cooling device 51 for cooling the gas passage section 50 at a temperature not lower than a boiling point of fluorine and not higher than a melting point of hydrogen fluoride so that the hydrogen fluoride gas mixed in the fluorine gas is coagulated, while the fluorine gas passes through the gas passage section 50. On the upstream of the first refining device 16*a* and the second refining device 16*b*, inlet valves 22*a* and 22*b* are provided, respectively, while outlet valves 23*a* and 23*b* are provided on the downstream, respectively. The inlet valves 22*a* and 22*b* and the outlet valves 23*a* and 23*b* are switched to open/close so that the fluorine gas generated at the anode 7 passes through only either of the first refining device 16*a* and the second refining device 16*b*. That is, if one of the first refining device 16*a* and the second refining device 16*b* is in an operating state, the other is in a stop or a standby state.

In the first main passage 15, a third differential pressure meter 53 is provided as a differential pressure detector for detecting a pressure difference between before and after the refining device 16. A detection result of the third differential pressure meter 53 is outputted to the controller 10. The controller 10 determines that an accumulated amount of hydrogen fluoride coagulated in the gas passage section 50 reached a predetermined amount if the differential pressure detected by the third differential pressure meter 53 reaches a set value stored in the ROM and determined in advance, and switches the operation of the refining device 16 by controlling opening/closing of the inlet valves 22*a* and 22*b* and the outlet valves 23*a* and 23*b*.

On the downstream of the first pump 17 in the first main passage 15, a buffer tank 21 for retaining the fluorine gas conveyed by the first pump 17 is provided. The fluorine gas retained in the buffer tank 21 is supplied to the external device 4. In the buffer tank 21, a second pressure meter 24 as a pressure detector for detecting an internal pressure is provided. A detection result of the second pressure meter 24 is outputted to the controller 10.

On the downstream of the buffer tank 21 in the first main passage 15, a flow meter 26 as a flow detector for detecting a flow rate of the fluorine gas supplied from the buffer tank 21 to the external device 4 is provided. A detection result of the flow meter 26 is outputted to the controller 10.

On the downstream of the flow meter 26 in the first main passage 15, a flow control valve 27 for controlling a flow rate of the fluorine gas supplied to the external device 4 is provided. An opening degree of the flow control valve 27 is controlled on the basis of a signal outputted from the controller 10. Specifically, the controller 10 controls the opening degree of the flow control valve 27 so that a flow rate of the fluorine gas detected by the flow meter 26 becomes a target flow rate stored in the ROM and determined in advance. The ROM of the controller 10 stores a plurality of target flow rates. The target flow rate is a flow rate of the fluorine gas required by the external device 4 and is changed by an operator operating the fluorine gas generating apparatus 100.

The controller 10 controls a current supplied between the anode 7 and the cathode 8 from a power supply 9 on the basis of the target flow rate of the fluorine gas. Specifically, a current value corresponding to the target flow rate is calculated, and the power supply 9 is controlled so that electricity having the current value is supplied between the anode 7 and the cathode 8. As such, a generation amount of the fluorine gas at the anode 7 is controlled so as to replenish the fluorine gas supplied from the buffer tank 21 to the external device 4.

Moreover, the controller 10 corrects the current value calculated on the basis of the target flow rate of the fluorine gas on the basis of a detection result of the second pressure meter 24. Specifically, if the pressure of the buffer tank 21 detected by the second pressure meter 24 is larger than the set range stored in the ROM and determined in advance, the calculated current value is corrected so as to decrease the calculated current value, while if the pressure of the buffer tank 21 is smaller than the set range, the calculated current value is corrected so as to increase the calculated current value. That is, the current value calculated on the basis of the target flow rate of the fluorine gas is corrected so that the pressure in the buffer tank 21 is kept within a set range (reference pressure). The set range of the pressure of the buffer tank 21 is set at a pressure higher than the atmospheric pressure.

As such, the fluorine gas supplied to the external device 4 is controlled to be replenished, and the internal pressure of the buffer tank 21 is controlled to a pressure higher than the atmospheric pressure. On the other hand, since the external device 4 side where the fluorine gas is at the atmospheric pressure, by opening the valve provided in the external device 4, the fluorine gas is supplied from the buffer tank 21 to the external device 4 by means of a pressure difference between the buffer tank 21 and the external device 4.

On the downstream of the flow control valve 27 in the first main passage 15, a second shut-off valve 28 for switching between supply and shut-off of the fluorine gas to the external device 4 is provided. Moreover, in the first main passage 15, a branch passage 55 is connected to the upstream of the second shut-off valve 28, and an abatement section 56 is provided on the downstream end of the branch passage 55. In the branch passage 55, a third shut-off valve 57 for switching between a flow and shut-off of the fluorine gas is provided. If the second shut-off valve 28 is in the closed valve state and the third shut-off valve 57 is in the open valve state, the fluorine gas in the first main passage 15 is discharged through the branch passage 55, made harmless in the abatement section 56 and emitted.

Subsequently, a byproduct gas treatment system 3 will be described.

To the second gas chamber 12*a*, a second main passage 30 for discharging the hydrogen gas to the outside is connected.

In the second main passage 30, a second pump 31 as a conveying device which leads and conveys the hydrogen gas out of the second gas chamber 12*a* is provided. Moreover, a second reflux passage 32 for connecting the discharge side and the suction side of the second pump 31 is connected to the second main passage 30. In the second reflux passage 32, a second pressure regulating valve 33 for returning the hydrogen gas discharged from the second pump 31 to the suction side of the second pump 31 is provided.

On the upstream of the second pump 31 in the second main passage 30, a third pressure meter 35 as a pressure detector for detecting a pressure of the second main passage 30 is provided. A detection result of the third pressure meter 35 is outputted to the controller 10.

An opening degree of the second pressure regulating valve 33 is controlled on the basis of a signal outputted from the controller 10. Specifically, the controller 10 controls the opening degree of the second pressure regulating valve 33 so that the pressure detected by the third pressure meter 35 becomes a second set value stored in the ROM and determined in advance.

On the downstream of the second pump 31 in the second main passage 30, an abatement section 34 is provided, and the hydrogen gas conveyed by the second pump 31 is made harmless in the abatement section 34 and emitted.

The fluorine gas generating apparatus 100 is also provided with a raw material supply system 5 for supplying hydrogen fluoride which is a material of the fluorine gas into the molten salt of the electrolytic cell 1. The raw material supply system 5 will be described below.

The raw material supply system 5 is provided with a hydrogen fluoride supply source 40 in which hydrogen fluoride to be replenished to the electrolytic cell 1 is retained. The hydrogen fluoride supply source 40 and the electrolytic cell 1 are connected through a raw material supply passage 41. The hydrogen fluoride retained in the hydrogen fluoride supply source 40 is supplied into the molten salt in the electrolytic cell 1 through the raw material supply passage 41.

In the raw material supply passage 41, a flow control valve 42 for controlling a supply flow rate of hydrogen fluoride is provided. An opening degree of the flow control valve 42 is controlled on the basis of a signal outputted from the controller 10. Specifically, the controller 10 controls the supply flow rate of the hydrogen fluoride so that a liquid level of the molten salt detected by the liquid level meter 14 becomes a predetermined level stored in the ROM and determined in advance. That is, the flow control valve 42 controls the supply flow rate of the hydrogen fluoride so as to replenish the hydrogen fluoride electrolyzed in the molten salt.

To the raw material supply passage 41, a carrier gas supply passage 46 for leading a carrier gas supplied from a carrier gas supply source 45 is connected. In the carrier gas supply passage 46, a shut-off valve 47 for switching between supply and shut-off of the carrier gas is provided. The carrier gas is a gas for leading hydrogen fluoride into the molten salt in the electrolytic cell 1, and a nitrogen gas which is an inactive gas is used. The shut-off valve 47 is in an open state in principle while the fluorine gas generating apparatus 100 is operating, and the nitrogen gas is supplied into the molten salt in a cathode chamber 12. The nitrogen gas is hardly dissolved in the molten salt but discharged from the second gas chamber 12*a* through byproduct gas treatment system 3. As a carrier gas, other inactive gases such as an argon gas, a helium gas and the like may be used.

A slight amount of moisture is contained in the molten salt of the electrolytic cell 1. This moisture is brought into the electrolytic cell 1 with hydrogen fluoride supplied through the raw material supply passage 41, brought into the electrolytic cell 1 with the nitrogen gas supplied to the raw material supply passage 41 through the carrier gas supply passage 46 or brought into the electrolytic cell 1 with the nitrogen gas purged through the liquid level meter 14. Moreover, the moisture contained in the molten salt includes not only moisture brought in during electrolysis but also moisture mixed in the molten salt from the beginning. If electrolysis is performed in a state where moisture concentration in the molten salt in the electrolytic cell 1 is high, the moisture in the molten salt reacts with a carbon electrode, which oxidizes the surface of the anode 7 and might cause an anodic effect. The anodic effect refers to a phenomenon in which an electrolytic voltage rises until continuation of the electrolysis becomes impossible. Then, in the electrolytic cell 1, a moisture concentration measuring device 59 for sampling the molten salt through a sampling passage 58 and measuring the moisture concentration in the molten salt is provided. For the measurement of the moisture concentration by the moisture concentration measuring device 59, Karl Fischer's method is used.

Moreover, in the first main passage 15, a gas concentration measuring device 61 for sampling the fluorine gas through a sampling passage 60 and measuring concentration of a reaction product such as OF2 generated in reaction between fluorine and moisture in the molten salt is provided. For the gas concentration measuring device 61, an infrared spectrophotometer is used.

It may be so configured that only either one of the moisture concentration measuring device 59 and the gas concentration measuring device 61 is provided.

Subsequently, by referring to FIGS. 2 to 6, an automatic operation control of the fluorine gas generating apparatus 100 executed by the controller 10 will be described.

In a stop state of the fluorine gas generating apparatus 100, the first shut-off valve 74 is in the open valve state, while the start valve 70, the inlet valves 22*a* and 22*b*, the outlet valves 23*a* and 23*b*, the second shut-off valve 28, and the third shut-off valve 57 other than the first shut-off valve 74 are in a closed valve state.

First, by referring to FIGS. 1 and 2, a start procedure of the electrolytic cell 1 will be described.

Figure 2:
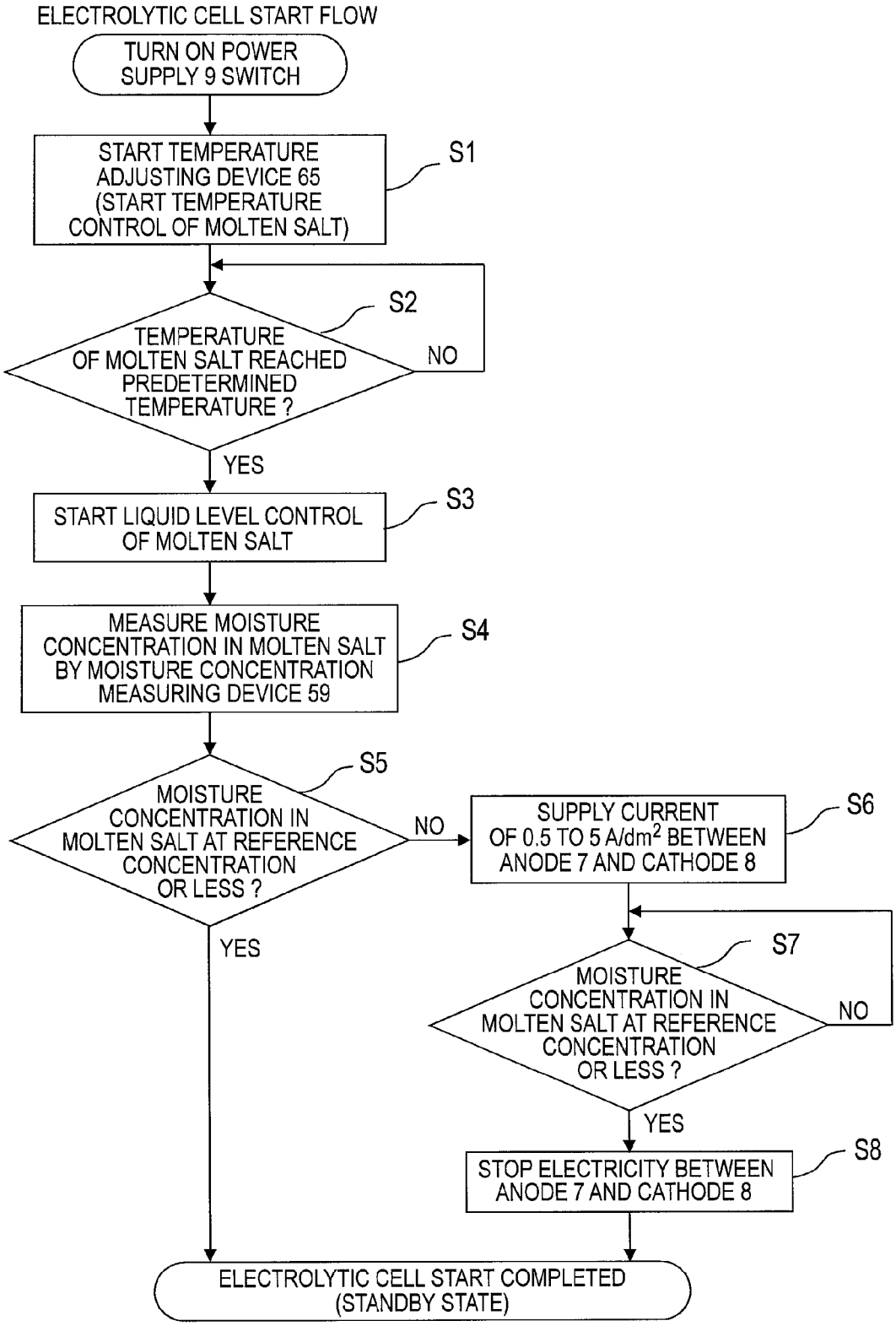
FIG. 2 is a flowchart illustrating a start procedure of an electrolytic cell.

A start flow of the electrolytic cell 1 illustrated in FIG. 2 is started when an operator turns ON a switch of the power supply 9 of the electrolytic cell 1.

At Step 1, the temperature adjusting device 65 is started, and steam is supplied from the heating/cooling device 67 to the jacket 66 and the tube of the electrolytic cell 1. As a result, the temperature of the molten salt rises.

At Step 2, it is determined whether the temperature of the molten salt has reached a predetermined temperature or not. If it is determined that the predetermined temperature has been reached, the routine proceeds to Step 3. The predetermined temperature is set to 80° C. at which the molten salt enters a molten state, for example. After the temperature of the molten salt has reached the predetermined temperature, the temperature of the molten salt is controlled by the heating/cooling device 67 to 85 to 95° C. on the basis of the detection result of the thermometer 69.

At Step 3, liquid level control of the molten salt by the flow control valve 42 is started. Specifically, the controller 10 adjusts the flow rate of the hydrogen fluoride supplied from the hydrogen fluoride supply source 40 to the electrolytic cell 1 by controlling the opening degree of the flow control valve 42 so that the liquid level of the molten salt becomes a predetermined level on the basis of the detection result of the liquid level meter 14. The predetermined level is set higher than a lower end portion of a partition wall 6 and lower than a support body (not shown) supporting electrodes 7 and 8.

At Step 4, the moisture concentration in the molten salt is measured by the moisture concentration measuring device 59.

At Step 5, it is determined whether or not the moisture concentration in the molten salt measured by the moisture concentration measuring device 59 is at a reference concentration or less stored in the ROM and determined in advance. If it is determined that the concentration is at the reference concentration or less, the start of the electrolytic cell 1 is completed. On the other hand, if it is determined that the reference concentration is exceeded, the routine proceeds to Step 6. The reference concentration is determined from the viewpoint of prevention of occurrence of the anodic effect, that is, protection of the anode 7 and is set to 500 wt. ppm, for example.

At Step 6, a current of 0.5 to 5 A/dm$^2$ is supplied between the anode 7 and the cathode 8 from the power supply 9. As a result, the fluorine gas is generated in the anode 7, and the fluorine gas is discharged from the first main passage 15 through the branch passage 72, made harmless in the abatement section 73 and emitted.

At Step 7, similarly to Step 6, it is determined whether or not the moisture concentration in the molten salt measured by the moisture concentration measuring device 59 is at the reference concentration or less. If it is determined that the concentration is at the reference concentration or less, the routine proceeds to Step 8. Electric connection between the anode 7 and the cathode 8 is continued until the moisture concentration in the molten salt becomes the reference concentration or less.

At Step 8, the electric connection between the anode 7 and the cathode 8 is stopped.

As such, the start of the electrolytic cell 1 is completed, and the electrolytic cell 1 enters a standby state where electricity can be supplied between the anode 7 and the cathode 8.

Instead of the measurement of the moisture concentration in the molten salt by the moisture concentration measuring device 59, concentration of a reaction product such as $OF_2$ or the like in the fluorine gas may be measured by the gas concentration measuring device 61. In that case, after the above-described Step 3, a current of 0.5 to 5 A/dm$^2$ is supplied from the power supply 9 between the anode 7 and the cathode 8, and the concentration of the reaction product in the fluorine gas generated in the anode 7 is measured. Then, if the concentration of the reaction product is at a reference concentration or less, electric connection between the anode 7 and the cathode 8 is stopped, so that the electrolytic cell 1 enters the standby state. On the other hand, if the concentration of the reaction product exceeds the reference concentration, the fluorine gas generated in the anode 7 is discharged through the branch passage 72, and when the concentration of the reaction product becomes the reference concentration or less, the electric connection between the anode 7 and the cathode 8 is stopped.

Subsequently, a supply preparation procedure of the fluorine gas will be described by referring to FIGS. 1 and 3.

Figure 3:
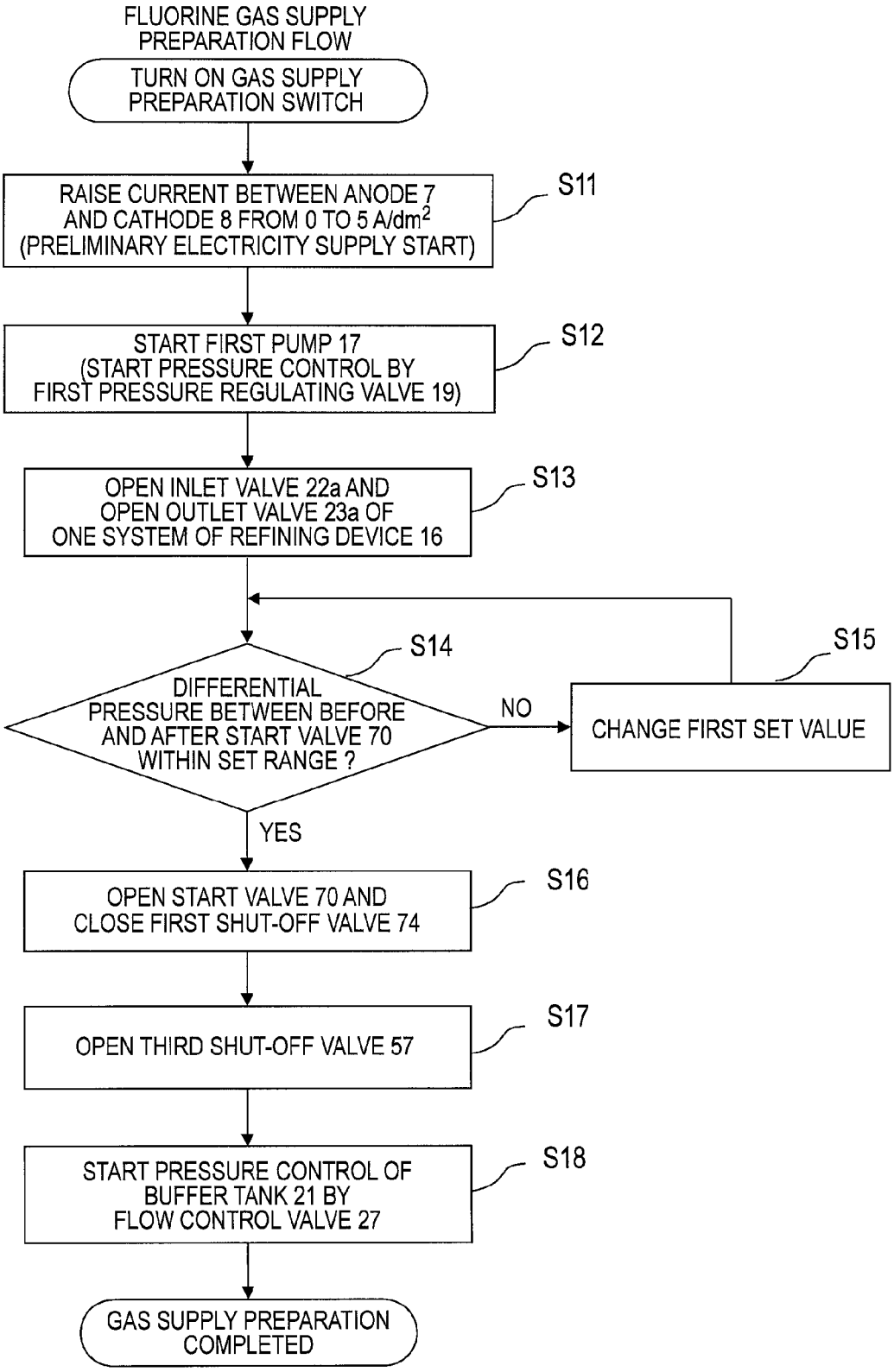
FIG. 3 is a flowchart illustrating a supply preparation procedure of a fluorine gas.

The supply preparation flow of the fluorine gas illustrated in FIG. 3 is started when an operator turns ON a gas supply preparation switch.

At Step 11, preliminary electric connection between the anode 7 and the cathode 8 is started. The current is raised in stepped manner from 0 A/dm$^2$ to 5 A/dm$^2$. As a result, a fluorine gas is generated in the anode 7, and the fluorine gas is discharged from the first main passage 15 through the branch passage 72, made harmless in the abatement section 73 and emitted.

At Step 12, the first pump 17 is started and pressure control of the first main passage 15 by the first pressure regulating valve 19 is started. Specifically, the controller 10 adjusts the fluorine gas flow rate refluxed through the first pressure regulating valve 19 by controlling the opening degree of the first pressure regulating valve 19 so that the pressure on the upstream side of the first pump 17 in the first main passage 15 becomes the first set value on the basis of the detection result of the first pressure meter 13. The first set value is set to 100.5 to 102.0 kPa, for example. If the detected pressure of the first pressure meter 13 is smaller than the first set value, the opening degree of the first pressure regulating valve 19 is set larger so that the fluorine gas flow rate refluxed to the suction side of the first pump 17 increases. On the other hand, if the detected pressure of the first pressure meter 13 is larger than the first set value, the opening degree of the first pressure regulating valve 19 is set smaller so that the fluorine gas flow rate refluxed to the suction side of the first pump 17 decreases. Here, if the detected pressure of the first pressure meter 13 is smaller than the first set value, in a state where the fluorine gas is pressure-accumulated in the buffer tank 21, the fluorine gas in the buffer tank 21 flows back to the first pump 17 side and is refluxed through the first pressure regulating valve 19.

At Step 13, the inlet valve and the outlet valve of one system of the refining device 16 are opened. Here, the inlet valve 22*a* and the outlet valve 23*a* of the first refining device 16*a* are opened, and the first refining device 16*a* and the first pump 17 are connected.

At Step 14, it is determined whether the pressure difference between before and after the start valve 70 detected by the second differential pressure meter 71 is within the set range or not. If it is determined that the difference is within the set range, the routine proceeds to Step 16. On the other hand, if it is determined that the set range is exceeded, the routine proceeds to Step 15.

At Step 16, the start valve 70 is opened, and the first shut-off valve 74 is closed, so that the first gas chamber 11*a* of the electrolytic cell 1 and the first pump 17 are connected. As a result, the fluorine gas generated in the anode 7 is conveyed by the first pump 17 and led to the buffer tank 21.

At Step 15, the first set value is changed so that the pressure difference between before and after the start valve 70 detected by the second differential pressure meter 71 falls within the set range. Specifically, if the differential pressure between before and after the start valve 70 exceeds the set range since the pressure on the upstream of the start valve 70 is larger than the pressure on the downstream, the first set value is changed to a larger value so as to increase the pressure on the downstream of the start valve 70. As a result, the opening degree of the first pressure regulating valve 19 becomes larger, and the differential pressure between before and after the start valve 70 becomes smaller. On the other hand, if the differential pressure between before and after the start valve 70 exceeds the set range since the pressure on the upstream of the start valve 70 is smaller than the pressure on the downstream, the first set value is changed to a smaller value so as to decrease the pressure on the downstream of the start valve 70. As a result, the opening degree of the first pressure regulating valve 19 becomes smaller, and the differential pressure between before and after the start valve 70 becomes smaller. The first set value is changed repeatedly until it is determined that the differential pressure between before and after the start valve 70 is within the set range. Then, if it is determined that the differential pressure is within the set range, the routine proceeds to Step 16, and the first gas chamber 11*a* and the first pump 17 are connected to each other as described above. The set range depends on the size of the electrolytic cell 1 and for example, set to 500 Pa.

As described above, valve opening of the start valve 70, that is, the connection between the first gas chamber 11*a* and the first pump 17 is performed if the differential pressure between before and after the start valve 70 is within the set range. Therefore, when the start valve 70 is opened, rapid inflow of the fluorine gas of the first gas chamber 11*a* into the downstream of the start valve 70 is prevented, thereby suppressing fluctuation in the liquid level of the anode chamber 11. Thus, the first gas chamber 11*a* and the first pump 17 can be stably connected.

At Step 17, the third shut-off valve 57 is opened, and the fluorine gas in the buffer tank 21 is discharged from the first main passage 15 through the branch passage 55, made harmless in the abatement section 56 and emitted.

At Step 18, pressure control of the buffer tank 21 by the flow control valve 27 is started. Specifically, the controller 10 controls the opening degree of the flow control valve 27 so that the pressure of the buffer tank 21 falls within the set range (reference pressure) on the basis of the detection result of the second pressure meter 24. The set range is set to a range of 110 to 400 kPa, for example. As described above, in the supply preparation procedure of the fluorine gas, the flow control valve 27 performs pressure control of the buffer tank 21 rather than the flow rate control of the fluorine gas.

As such, supply preparation of the fluorine gas is completed. As a result, in the fluorine gas generating apparatus 100, a required minimum current is supplied between the anode 7 and the cathode 8, and the fluorine gas generating apparatus enters a state where the fluorine gas can be supplied to the external device 4.

In the byproduct gas treatment system 3, too, in order to stably connect the second gas chamber 12*a* and the second pump 31, a start valve and a branch passage may be provided between the second gas chamber 12*a* and the second pump 31, and the procedures similar to the above-described Steps 12, 14, 15, and 16 may be performed similarly to the fluorine gas supply system 2. Moreover, it may be so configured that the second pump 31 is not provided in the byproduct gas treatment system 3 but the hydrogen gas generated in the cathode 8 is directly discharged through the second main passage 30.

Subsequently, by referring to FIGS. 1 and 4, the supply procedure of the fluorine gas and control of the fluorine gas generating apparatus 100 during a normal operation will be described.

Figure 4:
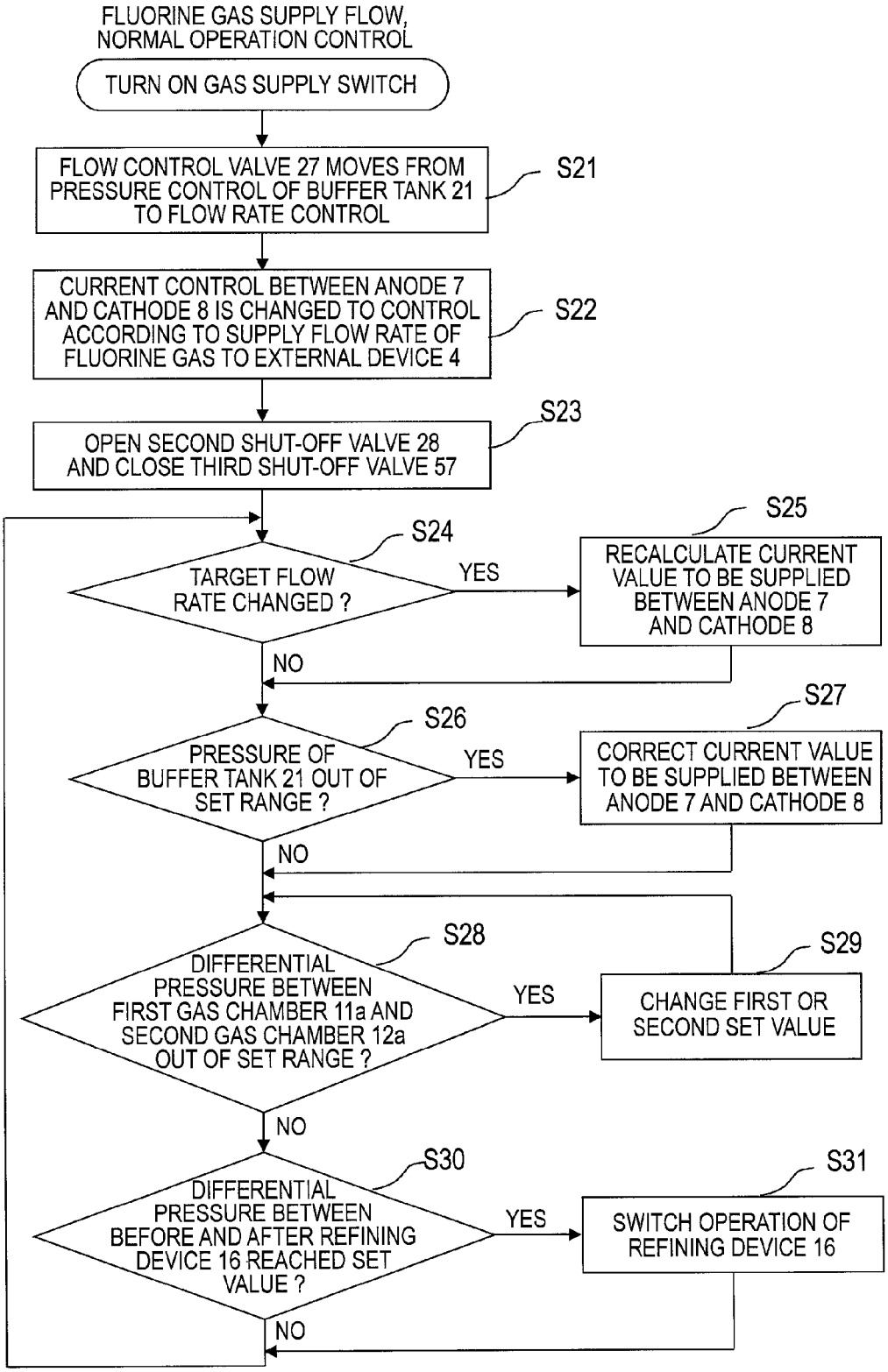
FIG. 4 is a flowchart illustrating a supply procedure of the fluorine gas.

The supply flow and normal operation control of the fluorine gas illustrated in FIG. 4 is started when an operator turns ON the gas supply switch.

At Step 21, the flow control valve 27 changes from the pressure control of the buffer tank 21 to the flow rate control of the fluorine gas. Specifically, the controller 10 controls the opening degree of the flow control valve 27 so that the flow rate of the fluorine gas detected by the flow meter 26 becomes a target flow rate. As a result, the fluorine gas flow rate detected by the flow meter 26 substantially matches the target flow rate.

At Step 22, the current control between the anode 7 and the cathode 8 is changed from 5 A/dm$^2$ constant control to control according to a supply flow rate of the fluorine gas to the external device 4. This control will be described in detail. A current value supplied between the anode 7 and the cathode 8 and a flow rate of the fluorine gas generated in the anode 7 have a relationship of a formula described below.

$$\text{Flow Rate (L/min)}=(\text{Current Value (A)}*60\ (\text{s/min})*22.4\ (\text{L/mol})*\text{Current Efficiency}(\%))/(\text{Faraday Constant}(96500\ \text{c/mol})*2) \quad \text{[Formula 1]}$$

Here, assuming that current efficiency is 95%, a flow rate of the fluorine gas is acquired by a formula described below.

$$\text{Flow Rate (L/min)}=\text{Current Value (A)}*6.6155*10^{-3} \quad \text{[Formula 2]}$$

The above-described formula (2) is stored in the ROM of the controller 10. The controller 10 calculates a current value corresponding to a target flow rate of the fluorine gas by using the above-described formula (2) and controls the power supply 9 so that the calculated current value is supplied between the anode 7 and the cathode 8. As a result, in the anode 7, the fluorine gas corresponding to a fluorine gas flow rate to be supplied to the external device 4 is generated.

At Step 23, the second shut-off valve 28 is opened, and the third shut-off valve 57 is closed. As a result, the fluorine gas in the buffer tank 21 is supplied to the external device 4 and the operation changes to a normal operation. In the following, the control of the normal operation will be described.

At Step 24, it is determined whether a target flow rate of the fluorine gas has been changed by the operator or not. If it is determined that the target flow rate has been changed, the routine proceeds to Step 25, and the current value corresponding to the changed target flow rate is re-calculated by using the above-described formula (2). The re-calculated current value is outputted to the power supply 9, and the power supply 9 supplies the re-calculated current value between the anode 7 and the cathode 8. Here, if the re-calculated current value is higher than the present current value of the power supply 9, the current value to be supplied between the anode 7 and the cathode 8 is raised to the re-calculated current value at a predetermined rising speed. On the other hand, if the re-calculated current value is lower than the present current value of the power supply 9, the current value to be supplied between the anode 7 and the cathode 8 is lowered to the re-calculated current value at once.

The lowest current value is set to the current value to be supplied between the anode 7 and the cathode 8. The lowest current value is set to approximately 0.5 A/dm$^2$, for example. Therefore, even if the target flow rate is 0 L/min, the current value to be supplied between the anode 7 and the cathode 8 is controlled so as not to fall below the lowest current value. However, if a state where the fluorine gas flow rate detected by the flow meter 26 continues to be at 0 L/min for a given time, supply stop of the fluorine gas which will be described later is executed (See FIG. 5).

At Steps 22 and 25, as the current value to be supplied between the anode 7 and the cathode 8, it was described that a current value corresponding to the target flow rate of the fluorine gas is calculated by using the above-described formula (2). However, as the current value to be supplied between the anode 7 and the cathode 8, a current value corresponding to the fluorine gas flow rate detected by the flow meter 26 may be calculated by using the above-described formula (2). That is, the flow rate (L/min) of the above-described formula (2) may be calculated not as the target flow rate of the fluorine gas but as the fluorine gas flow rate detected by the flow meter 26. By calculating the current value as above, if the fluorine gas flow rate to be supplied to the external device 4 is continuously changing, the flow rate of the fluorine gas generated in the electrode 7 can be controlled in correspondence with that.

After the current value is re-calculated at Step 25, the routine proceeds to Step 26. Moreover, if it is determined that the target flow rate has not been changed at Step 24, the routine proceeds to Step 26 without recalculation of the current value. As described in Steps 22 and 25, since the current value to be supplied between the anode 7 and the cathode 8 is calculated on the basis of the target flow rate of the fluorine gas, the fluorine gas corresponding to the fluorine gas flow rate to be supplied to the external device 4 is generated in the anode 7. That is, the fluorine gas to be supplied from the buffer tank 21 to the external device 4 is replenished by the fluorine gas generated in the anode 7, and thus, the pressure in the buffer tank 21 is theoretically kept constant all the time. However, since the current efficiency in the formula (1) fluctuates in a range of approximately 85 to 99%, there might be a difference between the fluorine gas flow rate to be supplied from the buffer tank 21 to the external device 4 and the fluorine gas flow rate generated in the anode 7. In that case, the pressure in the buffer tank 21 is not kept constant but fluctuates.

Thus, at Step 26, it is determined whether the pressure of the buffer tank 21 detected by the second pressure meter 24 is out of a set range or not. If it is determined that the pressure is out of the set range, the routine proceeds to Step 27, and the current value to be supplied between the anode 7 and the cathode 8 is corrected. Specifically, if the pressure of the buffer tank 21 is larger than the set range, the current value calculated at Step 22 or Step 25 is corrected to become smaller. For example, the value is corrected to approximately 90% of the calculated current value. On the other hand, if the pressure of the buffer tank 21 is smaller than the set range, the current value calculated at Step 22 or Step 25 is corrected to become larger. For example, the current value is corrected to approximately 110% of the calculated current value. As such, at Step 27, the calculated current value is corrected on the basis of the detection result of the second pressure meter 24. That is, the calculated current value is corrected on the basis of comparison between the detection result of the second pressure meter 24 and the set range (reference range) so that the pressure of the buffer tank 21 is kept within the set range (reference pressure). The set range is set to a range of 110 to 400 kPa, for example.

After the current value is corrected at Step 27, the routine proceeds to Step 28. If it is determined that the pressure of the buffer tank 21 is not out of the set range at Step 26, the routine proceeds to Step 28 without correcting the current value. The opening degree of the first pressure regulating valve 19 is controlled so that the pressure detected by the first pressure meter 13 becomes the first set value, and the opening degree of the second pressure regulating valve 33 is controlled so that the pressure detected by the third pressure meter 35 becomes the second set value. The first set value and the second set value are set to values so that the pressures of the first gas chamber 11*a* and the second gas chamber 12*a* become equal, that is, there should be no pressure difference between the both chambers. Therefore, control is basically executed so that the pressure difference between the first gas chamber 11*a* and the second gas chamber 12*a* does not become large. However, if a difference occurs between the pressures indicated by the first pressure meter 13 and the third pressure meter 35 and actual pressures due to an instrumental error or the like, or if a pressure loss from the first pressure meter 13 and the third pressure meter 35 to the electrolytic cell 1 is changed over time and the like, it is likely that the pressure difference between the first gas chamber 11*a* and the second gas chamber 12*a* becomes large. The pressure difference between the first gas chamber 11*a* and the second gas chamber 12*a* has a large influence on a difference in the liquid level between the anode chamber 11 and the cathode chamber 12, and if the difference in the liquid level between the both chambers becomes large, it is concerned that the fluorine gas in the first gas chamber 11*a* is brought into contact and react with the hydrogen gas in the second gas chamber 12*a*.

Then, at Step 28, it is determined whether the pressure difference between the first gas chamber 11*a* and the second gas chamber 12*a* detected by the first differential pressure meter 20 is out of a set range or not. If it is determined that the difference is out of the set range, the routine proceeds to Step 29, and the first set value or the second set value is changed so that the pressure difference between the first gas chamber 11*a* and the second gas chamber 12*a* detected by the first differential pressure meter 20 falls within a set range stored in the ROM and determined in advance. Specifically, if the differential pressure between the both chambers exceeds the set range since the pressure of the first gas chamber 11*a* is larger than the pressure of the second gas chamber 12*a*, the first set value is changed to a smaller value so as to decrease the pressure of the first gas chamber 11*a* or the second set value is changed to a larger value so as to increase the pressure of the second gas chamber 12*a*. As a result, the opening degree of the first pressure regulating valve 19 is made smaller or the opening degree of the second pressure regulating valve 33 is made larger, whereby the pressure difference between the first gas chamber 11*a* and the second gas chamber 12*a* is made smaller. On the other hand, if the differential pressure between the both chambers exceeds the set range since the pressure of the first gas chamber 11*a* is smaller than the pressure of the second gas chamber 12*a*, the first set value is changed to a larger value so as to increase the pressure of the first gas chamber 11*a* or the second set value is changed to a smaller value so as to decrease the pressure of the second gas chamber 12*a*. As a result, the opening degree of the first pressure regulating valve 19 is made larger or the opening degree of the second pressure regulating valve 33 is made smaller, whereby the pressure difference between the first gas chamber 11*a* and the second gas chamber 12*a* is made smaller. Instead, both the first set value and the second set value may be changed at the same time. That is, at Step 29, at least one of the first set value and the second set value is changed. The first set value and the second set value is changed repeatedly until the differential pressure between the both chambers is determined to be within the set range. If it is determined that the differential pressure is within the set value, the routine proceeds to Step 30. The set range depends on the size of the electrolytic cell 1 and for example, set to 500 Pa.

As described above, since the pressure difference between the first gas chamber 11*a* and the second gas chamber 12*a* is controlled so as to be in the set range by changing the first set value and the second set value, if a difference occurs between the pressures indicated by the first pressure meter 13 and the third pressure meter 35 and actual pressures due to an instrumental error or the like, or even if a pressure loss from the first pressure meter 13 and the third pressure meter 35 to the electrolytic cell 1 is changed over time and the like, a difference in the liquid level between the anode chamber 11 and the cathode chamber 12 is prevented, and thereby the liquid level of the electrolytic cell 1 can be stably controlled.

At the above-described Step 28, the change of at least one of the first set value and the second set value is described, but it may be so controlled that the pressure difference between the first gas chamber 11*a* and the second gas chamber 12*a* falls within the set range by changing only the first set value.

Moreover, the first pressure meter 13 detects a pressure on the upstream side of the first pump 17 in the first main passage 15 and does not directly detect the pressure of the first gas chamber 11*a*. Similarly, the third pressure meter 35 detects a pressure on the upstream side of the second pump 31 in the second main passage 30 and does not directly detect the pressure of the second gas chamber 12*a*. Thus, in order to eliminate the influence of the change over time of the pressure loss from the first pressure meter 13 and the third pressure meter 35 to the electrolytic cell 1, a pressure meter for directly detecting the pressures of the first gas chamber 11*a* and the second gas chamber 12*a* may be provided in the anode chamber 11 and the cathode chamber 12 of the electrolytic cell 1, respectively, and the opening degrees of the first pressure regulating valve 19 and the second pressure regulating valve 33 may be controlled so that the detection results of the pressure meter become the first set value and the second set value. However, in this case, too, a difference can occur between the pressure indicated by the pressure meter and the actual pressure in the gas chamber due to an instrumental error or the like, and thus, it is effective to change the first set value and the second set value so that the pressure difference between the first gas chamber 11*a* and the second gas chamber 12*a* is within the set range as at Steps 28 and 29.

At Step 30, it is determined whether the differential pressure between before and after the refining device 16 detected by the third differential pressure meter 53 has reached a set value or not. If it is determined that the set value is not reached, the routine returns to Step 24. On the other hand, if it is determined that the set value has been reached, the routine proceeds to Step 31.

At Step 31, it is determined that an accumulated amount of hydrogen fluoride coagulated in the gas passage section 50 of the first refining device 16*a* has reached a predetermined amount, and the operation is switched from the first refining device 16*a* to the second refining device 16*b*. Specifically, the inlet valve 22*b* and the outlet valve 23*b* of the second refining device 16*b* during stoppage are opened and then, the inlet valve 22*a* and the outlet valve 23*a* of the first refining device 16*a* while operating are closed so as to switch the operation. After the switching of the operation of the refining device 16 is completed, the routine returns to Step 24.

During the normal operation, Step 24 to Step 31 are repeated.

Subsequently, by referring to FIGS. 1 and 5, the supply stop procedure of the fluorine gas will be described.

Figure 5:
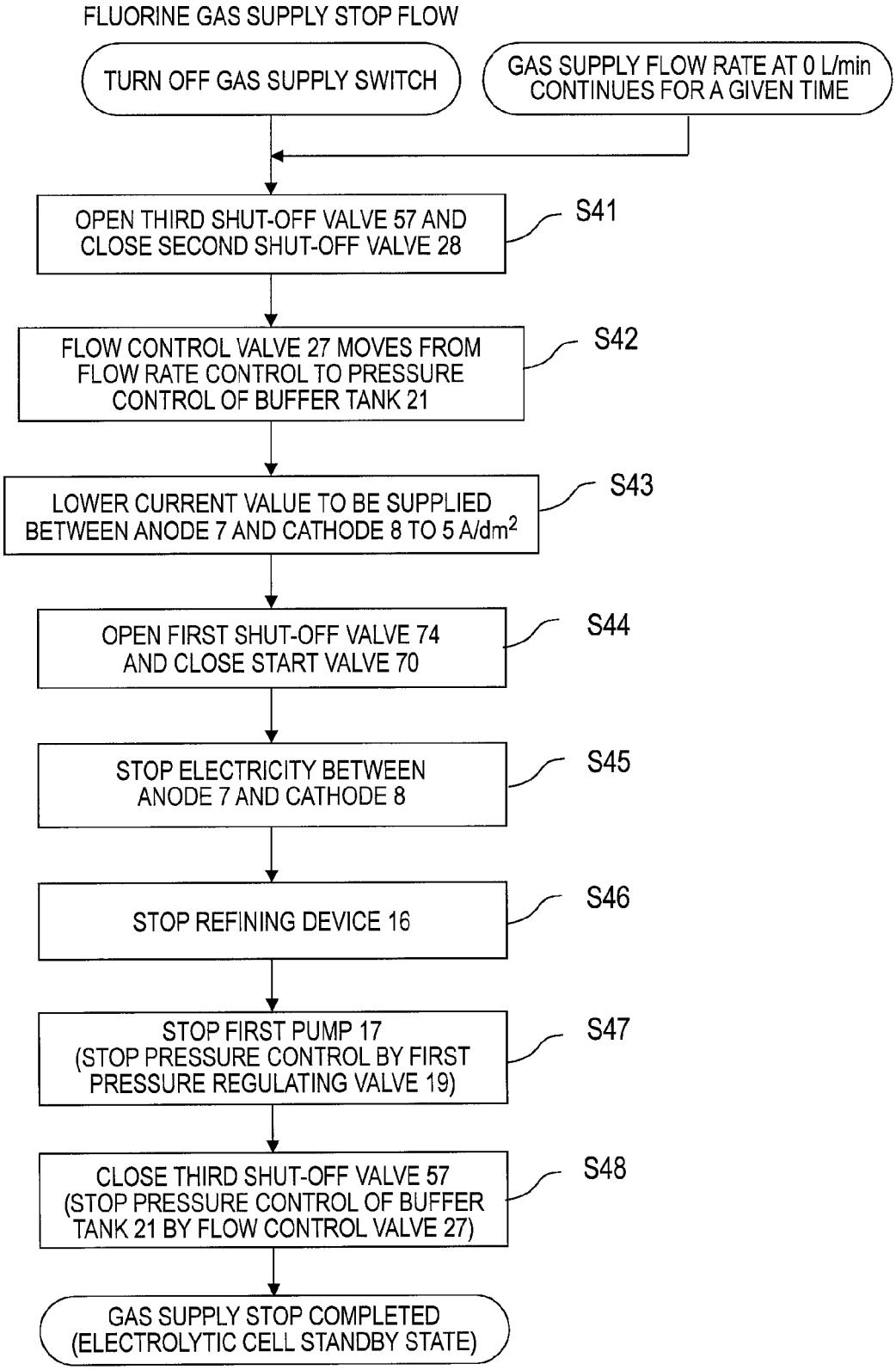
FIG. 5 is a flowchart illustrating a supply stop procedure of the fluorine gas.

The supply stop flow of the fluorine gas illustrated in FIG. 5 is started when the operator turns OFF the gas supply switch. Moreover, if the state where the fluorine gas flow rate detected by the flow meter 26 is at 0 L/min continues for a given time, that is, if the state where the fluorine gas supply flow rate to the external device 4 is at 0 L/min continues for a given time, the supply stop flow of the fluorine gas illustrated in FIG. 5 is started as described at Step 24.

At Step 41, the third shut-off valve 57 is opened, and the second shut-off valve 28 is closed. As a result, supply of the fluorine gas to the external device is stopped, and the fluorine gas of the buffer tank 21 is discharged through the branch passage 55, made harmless in the abatement section 56 and emitted.

At Step 42, the flow control valve 27 changes from the flow rate control of the fluorine gas to the pressure control of the buffer tank 21. Specifically, the controller 10 controls the opening degree of the flow control valve 27 so that the pressure of the buffer tank 21 is within a set range on the basis of the detection result of the second pressure meter 24.

At Step 43, the current value to be supplied between the anode 7 and the cathode 8 is lowered to 5 A/dm$^2$. As a result of continuation of the state where the fluorine gas flow rate detected by the flow meter 26 is at 0 L/min for a given time, if the fluorine gas supply stop flow proceeds, this Step 43 is skipped.

At Step 44, the first shut-off valve 74 is opened, and the start valve 70 is closed. As a result, the fluorine gas generated in the anode 7 is discharged through the branch passage 72, made harmless in the abatement section 73 and emitted.

At Step 45, electric connection between the anode 7 and the cathode 8 is stopped.

At Step 46, the inlet valve 22*b* and the outlet valve 23*b* of the second refining device 16*b* during operation are closed, and the refining device 16 is stopped.

At Step 47, the first pump 17 is stopped, and the pressure control of the first main passage 15 by the first pressure regulating valve 19 is stopped.

At Step 48, the third shut-off valve 57 is closed, and the pressure control of the buffer tank 21 by the flow control valve 27 is stopped.

As above, the supply stop of the fluorine gas is completed, and the electrolytic cell 1 enters the standby state.

Subsequently, by referring to FIGS. 1 and 6, the stop procedure of the electrolytic cell 1 will be described. The stoppage of the electrolytic cell 1 is performed when the fluorine gas generating apparatus 100 is to be stopped for a long time.

Figure 6:
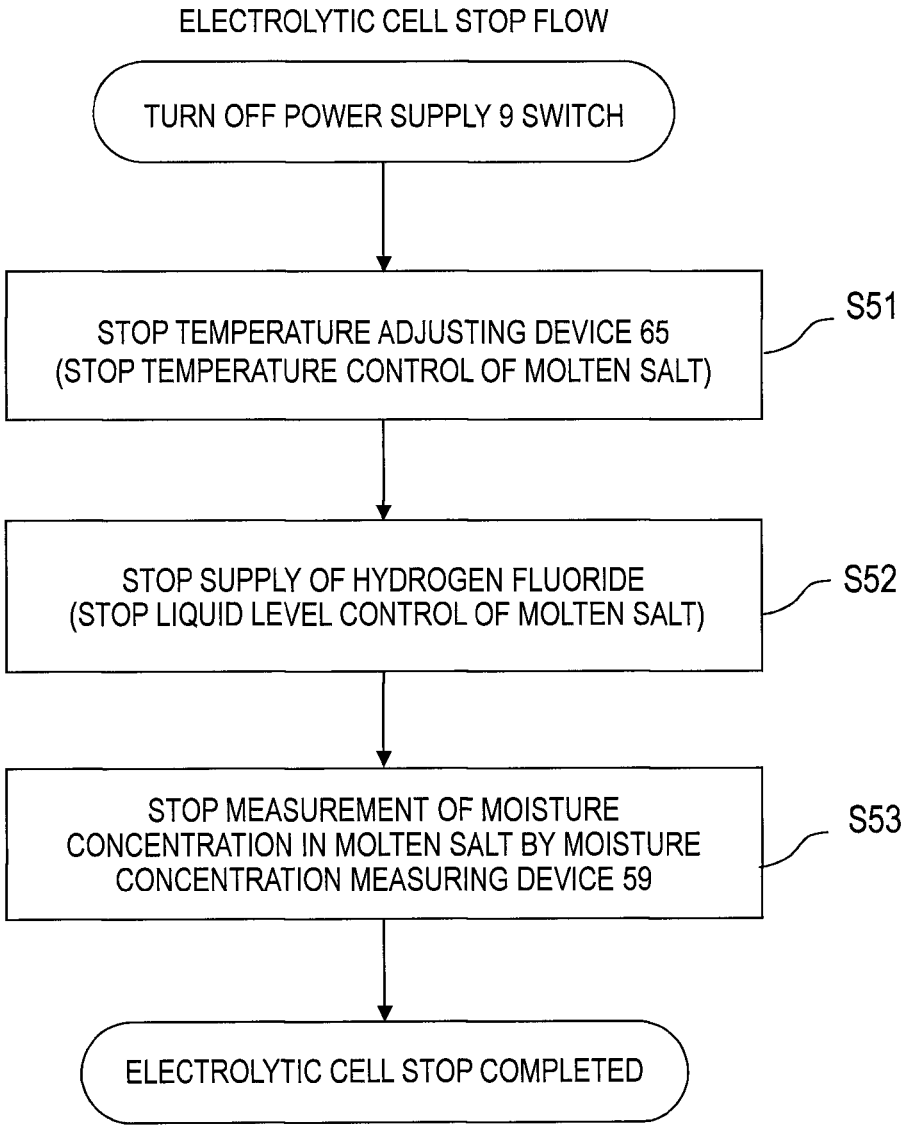
FIG. 6 is a flowchart illustrating a stop procedure of the electrolytic cell.

The stop flow of the electrolytic cell 1 illustrated in FIG. 6 is started when the operator turns OFF the switch of the power supply 9 of the electrolytic cell 1.

At Step 51, the temperature adjusting device 65 is stopped, and temperature control of the molten salt is stopped.

At Step 52, the flow control valve 42 is closed, and supply of the hydrogen fluoride from the hydrogen fluoride supply source 40 to the electrolytic cell 1 is stopped. As a result, the liquid level control of the molten salt is stopped.

At Step 53, the moisture concentration measurement in the molten salt by the moisture concentration measuring device 59 is stopped. If the gas concentration measuring device 61 is used instead of the moisture concentration measuring device 59, the concentration measurement of the reaction product in the fluorine gas by the gas concentration measuring device 61 is stopped.

The stoppage of the electrolytic cell 1 is completed as above. As a result, the stoppage of the fluorine gas generating apparatus 100 is completed.

According to the above-described embodiment, the following working effects are exerted.

Since the current value supplied between the anode 7 and the cathode 8 from the power supply 9 is calculated on the basis of the fluorine gas flow rate supplied from the buffer tank 21 to the external device 4 and the calculated current value is corrected on the basis of the pressure of the buffer tank 21, the fluorine gas can be automatically supplied to the external device 4 stably.

Moreover, at the start of the fluorine gas generating apparatus 100, the controller 10 changes the first set value so that the pressure difference detected by the second differential pressure meter 71 falls within the set range determined in advance and opens the start valve 70 when the pressure difference falls within the set range. As such, the start valve 70 is opened while the pressure difference between the upstream and the downstream is small, and the first gas chamber 11*a* and the first pump 17 are connected. Therefore, at the start of the fluorine gas generating device 100, fluctuation on the liquid level of the electrolytic cell 1 can be suppressed.

Moreover, during the normal operation of the fluorine gas generating apparatus 100, the controller 10 controls the opening degree of the first pressure regulating valve 19 so that the pressure detected by the first pressure meter 13 becomes the first set value determined in advance and changes the first set value or the second set value so that the pressure difference between the first gas chamber 11*a* and the second gas chamber 12*a* detected by the first differential pressure meter 20 falls within the set range determined in advance. Therefore, the pressure difference between the first gas chamber 11*a* and the second gas chamber 12*a* is prevented from increasing, and the liquid level of the electrolytic cell 1 can be stably controlled.

As described above, in the fluorine gas generating apparatus 100, in order to keep the liquid level fluctuation of the electrolytic cell 1 at the start and during the normal operation to the minimum, the pressures of the first main passage 15, the first gas chamber 11*a*, and the second gas chamber 12*a* are controlled with high accuracy.

It is obvious that the present invention is not limited to the above-described embodiment but is capable of various changes within a range of technical ideas thereof.

For example, in FIG. 1, the controller 10 is illustrated for each device and valve, but it may be so configured that a detection result of each instrument is outputted to one controller so that the one controller controls an operation of each device and each valve.

Moreover, in the above-described embodiment, the example in which the refining device 16 is a cryogenic refining device for separating and removing a hydrogen fluoride gas from a fluorine gas by using a difference in the boiling point between fluorine and hydrogen fluoride is described. As the refining device 16, instead of the cryogenic refining device, a device for having the hydrogen fluoride gas in the fluorine gas adsorbed by an adsorbing agent such as sodium fluoride (NaF) so as to separate and remove the hydrogen fluoride gas from the fluorine gas may be used.

The present application claims priority on the basis of Japanese Patent Application No. 2010-95219 filed with Japanese Patent Office on Apr. 16, 2010 and the whole contents of this application is incorporated in this description by reference.

What is claimed is:

1. A fluorine gas generating apparatus for generating a fluorine gas by electrolyzing hydrogen fluoride in molten salt, comprising:

an electrolytic cell in which a first gas chamber into which a product gas mainly containing the fluorine gas generated at an anode immersed in the molten salt is led and a second gas chamber into which a byproduct gas mainly containing a hydrogen gas generated at a cathode immersed in the molten salt is led are separated and defined on a liquid level of the molten salt;

a main passage connected to the first gas chamber and supplying the product gas generated at the anode of the electrolytic cell to an external device;

conveying device provided in the main passage and leading out and conveying the product gas from the first gas chamber;

a pressure detector for detecting a pressure on an upstream side of the conveying device in the main passage;

a reflux passage connecting a discharge side and a suction side of the conveying device;

a pressure regulating valve provided in the reflux passage and returning the product gas discharged from the conveying device to the suction side of the conveying device;

a controller configured to control an opening degree of the pressure regulating valve so that the pressure detected by the pressure detector becomes a set value determined in advance;

a start valve provided on an upstream side of the pressure detector in the main passage and allowing a flow of the product gas generated at the anode by opening at start of the fluorine gas generating apparatus; and a differential pressure detector for detecting a pressure difference before and after the start valve in a closed valve state, wherein the pressure difference detected by the differential pressure detector is upstream of the conveying device, wherein at start of the fluorine gas generating apparatus, the controller changes the set value so that the pressure difference detected by the differential pressure detector falls within a set range determined in advance and opens the start valve when the pressure difference falls within the set range.

2. A method for operating a fluorine gas generating apparatus for generating a fluorine gas by electrolyzing hydrogen fluoride in molten salt, the fluorine gas generating apparatus comprising:

an electrolytic cell in which a first gas chamber into which a product gas mainly containing the fluorine gas generated at an anode immersed in the molten salt is led and a second gas chamber into which a byproduct gas mainly containing a hydrogen gas generated at a cathode immersed in the molten salt is led are separated and defined on a liquid level of the molten salt;

a main passage connected to the first gas chamber and supplying the product gas generated at the anode of the electrolytic cell to an external device;

conveying device provided in the main passage and leading out and conveying the product gas from the first gas chamber;

a pressure detector for detecting a pressure on an upstream side of the conveying device in the main passage;

a reflux passage connecting a discharge side and a suction side of the conveying device;

a pressure regulating valve provided in the reflux passage and returning the product gas discharged from the conveying device to the suction side of the conveying device;

a controller for controlling an opening degree of the pressure regulating valve so that the pressure detected by the pressure detector becomes a set value determined in advance;

a start valve provided on an upstream side of the pressure detector in the main passage and allowing a flow of the product gas generated at the anode by opening at start of the fluorine gas generating apparatus; and a differential pressure detector for detecting a pressure difference before and after the start valve in a closed valve state, the method comprising:

at start of the fluorine gas generating apparatus, changing the set value of the controller to change the opening degree of the pressure regulating valve and to change the pressure detected by the pressure detector so that the pressure difference detected by the differential pressure detector falls within a set range determined in advance, and opening the start valve when the pressure difference falls within the set range.

* * * * *